US006691326B2

(12) United States Patent
Hexels

(10) Patent No.: US 6,691,326 B2
(45) Date of Patent: Feb. 17, 2004

(54) GARMENT FOR PROTECTION AGAINST CHEMICAL AND/OR BIOLOGICAL SUBSTANCES

(75) Inventor: Gerd Hexels, Nettetal (DE)

(73) Assignee: Texplorer GmbH, Nettetal (DE)

( * ) Notice: Subject to any disclaimer, the term of this patent is extended or adjusted under 35 U.S.C. 154(b) by 22 days.

(21) Appl. No.: 10/145,977

(22) Filed: May 14, 2002

(65) Prior Publication Data

US 2002/0189006 A1 Dec. 19, 2002

(30) Foreign Application Priority Data

Jun. 19, 2001 (DE) ..... 201 10 132 U

(51) Int. Cl.[7] ..... A62B 17/00
(52) U.S. Cl. ..... 2/457; 2/2.17
(58) Field of Search ..... 2/457, 2.17, 96, 2/97, 265, 270, 458, 2.15, 82, 87; 24/394, 393; 112/475.16, 152, 470.33; 29/408

(56) References Cited

U.S. PATENT DOCUMENTS 2,385,816 A * 10/1945 Krupp ..... 24/387
2,746,113 A * 5/1956 Williams ..... 24/389
3,417,406 A * 12/1968 Rosenbaum ..... 2/2.17
3,421,188 A * 1/1969 Rock ..... 24/443
3,490,109 A * 1/1970 Heimberger ..... 24/389
3,668,745 A * 6/1972 Krupp ..... 24/389
4,103,361 A * 8/1978 Carmen ..... 2/97
4,112,556 A * 9/1978 Flaum et al. ..... 24/382
4,272,851 A * 6/1981 Goldstein ..... 2/79
4,293,957 A * 10/1981 Melarvie ..... 2/2.17
4,612,916 A * 9/1986 Akers et al. ..... 600/21
4,920,575 A * 5/1990 Bartasis et al. ..... 2/457
4,987,657 A * 1/1991 Moreland ..... 24/389
4,996,933 A * 3/1991 Boser ..... 112/475.06
5,007,112 A * 4/1991 Lewis et al. ..... 2/457
5,129,127 A * 7/1992 Hamatani ..... 24/394
5,189,737 A * 3/1993 Ribicic ..... 2/93
5,386,616 A * 2/1995 Norvell ..... 24/389
5,444,898 A * 8/1995 Norvell ..... 24/389
5,529,823 A * 6/1996 Aumann ..... 428/53
5,864,879 A * 2/1999 Bercane ..... 2/93
6,092,266 A * 7/2000 Lee ..... 24/389
6,223,349 B1 * 5/2001 Roiser ..... 2/2.17
6,237,152 B1 * 5/2001 Gootrad ..... 2/87
6,364,980 B1 * 4/2002 Smith et al. ..... 156/108

* cited by examiner

*Primary Examiner*—John J. Calvert
*Assistant Examiner*—Alissa L Hoey
(74) *Attorney, Agent, or Firm*—Davis & Bujold, PLLC

(57) ABSTRACT

A garment for protection against chemical and/or biological substances is provided with a shell and a lining, arranged under said shell, and with at least one zip fastener, which has two zip fastener halves which engage in one another during closing. Each zip fastener half is provided with at least two stringers, an outer stringer being joined to the shell and the other, inner stringer being joined to the lining. At least one of the two stringers is provided with a protective layer which is impermeable to chemical and/or biological substances. The shell and/or the lining is likewise impermeable to chemical and/or biological substances.

28 Claims, 1 Drawing Sheet

GARMENT FOR PROTECTION AGAINST CHEMICAL AND/OR BIOLOGICAL SUBSTANCES

The invention relates to a garment for protection against chemical and/or biological substances with a shell and a lining, arranged under said shell, and with at least one zip fastener. The invention also relates to a zip fastener device for protection against chemical and/or biological substances.

Garments for persons who are exposed to chemical or biological substances or else for whom there is just the risk that they could be exposed to substances of this type, such as in the military sector for example, must be made up in such a way that the harmful substances do not reach the body or underwear of the person wearing the garment.

Garments of this type, such as jackets or pants for example, are often provided with a zip fastener to adapt them to the person wearing them or to make it easier to put them on or take them off. However, conventional zip fasteners cannot be used for garments intended to offer the wearer protection against chemical or biological substances.

The present invention is therefore based on the object of providing a garment which ensures that, even when zip fasteners are used, impermeability to chemical and/or biological substances is maintained. In addition, it is intended as far as possible for waterproofness and at the same time breathability of the system to be provided.

This object is achieved according to the invention by the features stated in claim 1.

The configuration of the zip fastener with the two stingers on each zip fastener half, one stringer, that is the outer stringer, being joined to the shell and the second stringer, that is the inner stringer, being joined to the lining, allows impermeability to chemical and/or biological substances to be achieved.

The outer stringer is fastened to the shell in a conventional way. The inner stringer, which according to the invention is joined to the lining or the lining system, generally by sewing with subsequent sealing of the seam by adhesive bonding or fusion, serves the purpose of avoiding sealing against ingress of harmful chemical or biological substances. The inner tape also serves at the same time, along with its sealing function, for relieving the tension of the lining material of the lining layer, which is generally susceptible to tearing.

In addition to or instead of an impermeability to chemical and/or biological substances by means of a corresponding protective layer, which is joined to the inner stringer or is integrated in it, it is of course also possible for the outer stringer to be correspondingly designed.

In an advantageous configuration of the invention, it may be provided for this purpose that the inner stringer comprises a coated woven fabric, for example of polyurethane, onto which the outer stringer is then fused.

The outer stringer at the same time also protects the lining layer from mechanical effects.

The protective layer, which is either integrated in the inner stringer or applied to it, serves not only for sealing against ingress of chemical or biological substances but also for gas-impermeability and waterproofness. If need be, water-vapor permeability from the inside to the outside may also be provided, for wicking away body perspiration.

Advantageous configurations and developments of the invention emerge from the subclaims and from the exemplary embodiment described in principle below with reference to the drawing, in which:

Figure 1:
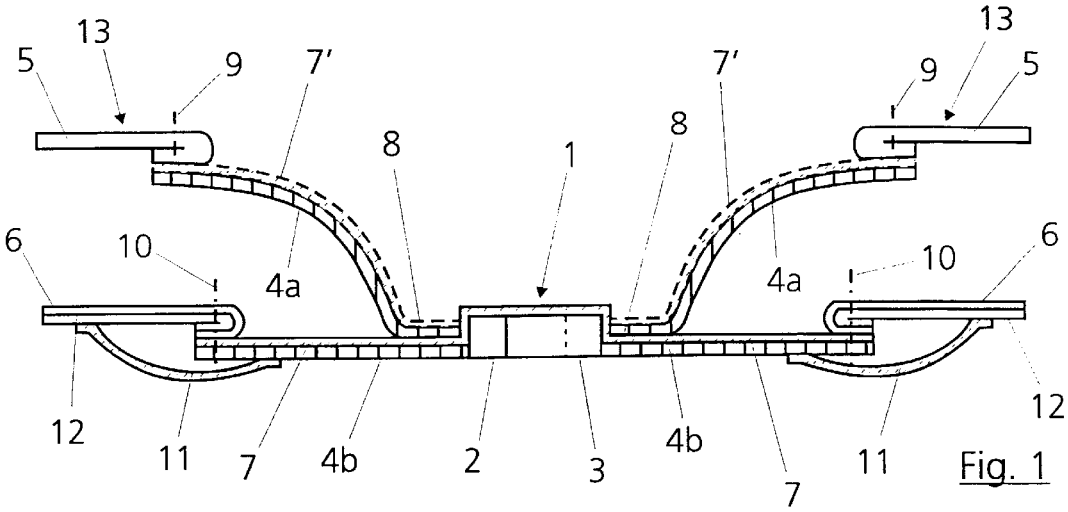
FIG. 1 shows a cross section through a configuration of the zip fastener device according to the invention, with two separate stringers on each side of the zip fastener.

The figures show a zip fastener device which has a zip fastener 1, which has, in a known way, two zip fastener halves 2 and 3 which are arranged in parallel next to each other and engage with their teeth in one another during the closing of the zip fastener 1. The zip fastener 1 can be opened from one or both sides.

For the zip fastener, a configuration which is impermeable to gas and dust should be chosen. A plastic helical-coil zip fastener arranged on a woven fabric, as used in watersports for example, is one type of fastener suitable for this. The two zip fastener halves 2 and 3 are in this case designed as halves of a helical coil with sealing lips, which are embedded and fixed in a plastic profile. Since zip fasteners of this type are generally known and, if need be, other types can also be used, such as zip fasteners with lateral rows of teeth, the zip fastener 1 with the two zip fastener halves 2 and 3 is represented only in principle in the drawing. All that is important is that it is impermeable, or becomes impermeable in connection with the configuration according to the invention.

FIG. 1 shows a configuration of the zip fastener device, the two zip fastener halves 2 and 3 being represented in their closed state.

In this case, two separate stringers are provided on each side, that is an upper or outer stringer 4*a* for joining to a shell 5 and a lower or inner stringer 4*b* for joining to a lining 6.

The two outer stringers 4*a* are made of a woven fabric, for example nylon. A coating of polyurethane as a protective layer 7 is located between the respectively outer stringer 4*a* and the respectively inner stringer 4*b*, the two stringers 4*a*, 4*b* being joined to each other in the inner region, i.e. in the region in which the two stringers 4*a*, 4*b* are joined to the two zip fastener halves 2 and 3, respectively, in the form of a strip 8, by the protective layer 7 lying between. The width of the strip may be, for example, 5 mm. The thickness of the protective layer 7 may be between 0.2 and 0.4 mm, preferably 0.3 mm. The protective layer 7 is respectively applied to the outside of the inner stringer 4*b* and also extends over the zip fastener 1. In this way, the entire zip fastener device can be made impermeable to chemical and/or biological substances. Instead of polyurethane, of course some other material by which impermeability is ensured can also be used. The two outer stringers 4*b* may also be fused to the inner stringers 4*a* by means of the protective layer 7.

Additionally or alternatively, the two outer stringers 4*a* may also be provided with a protective layer 7', as indicated by dashed lines in FIG. 1.

The joining of the respectively outer stringer 4*a* to the shell 5 of the garment may take place in a known way, for example by a sewn seam 9. The same applies to the joining of the respectively inner stringer 4*b* to the lining 6. Here, too, a sewn seam 10 may be provided. Instead of a sewn seam 9 or 10, an adhesive bond is also possible.

Since the sewn seams 9 and 10 represent places where there is a lack of impermeability, there will be provided a seam sealing tape 11, which is for example fastened by one end to the respectively inner stringer 4*b* and at the other end to the lining 6, for example fused or adhesively bonded in a gas impermeable manner.

Nylon may be provided, for example, as the shell 5, but if need be any other material, such as polyester/cotton blends, polyester or aramid-grade nomex, may be provided.

As the lining 6, a laminate which is correspondingly impermeable to chemical and/or biological substances may be used. Possible for this, for example, is polyester knitwear in which a membrane 12 that is impermeable to the chemical and/or biological substances is incorporated. For the lining 6, nylon fabric, fleece, flame-retardant and other materials are also conceivable.

The lining 6 may, if need be, also be made waterproof, but at the same time breathable. The same also applies to the shell 5.

As is evident, the zip fastener device according to the invention allows a garment which is safe from chemical and/or biological substances that are harmful to the wearer to be provided.

Figure 2:
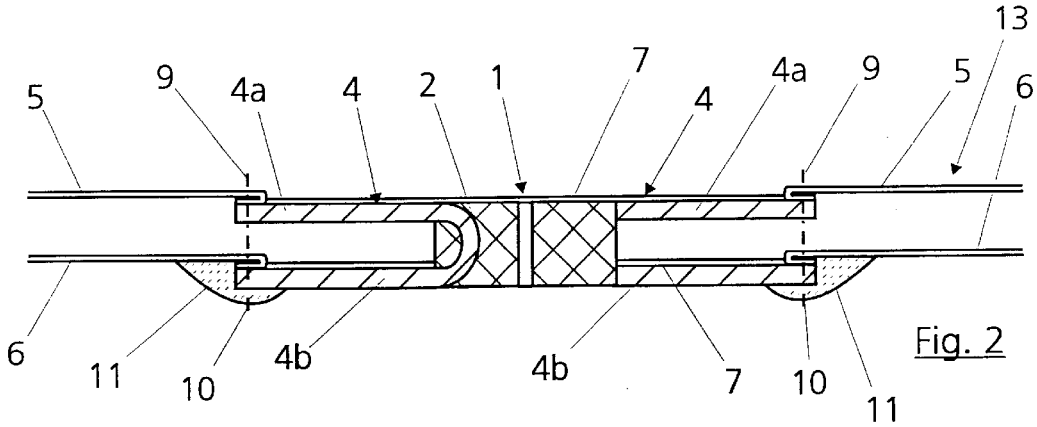
FIG. 2 shows a cross section through a zip fastener device according to the invention, with two lateral stringers in each case, which are produced from a shared tape formed into a U shape.
Figure 3:
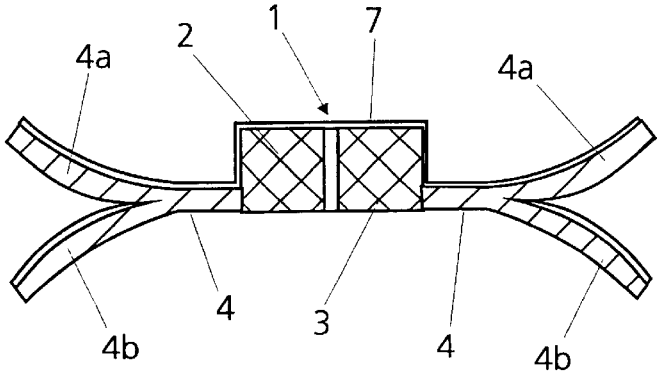
FIG. 3 shows a cross section through a lateral tape, respectively, which is split at its free end in each case for forming two stringers.

FIGS. 2 and 3 show a zip fastener device that is identical in principle, for which reason the same reference numerals have also been retained for the same parts.

The differences are merely that the two stringers 4*a* and 4*b* on each side are produced from a single tape 4.

According to FIG. 2, joined to each zip fastener half 2 and 3 is a tape 4, which is bent over in the region where it joins the associated zip fastener half 2 or 3, respectively, into a U-profile shape and in this way forms two laterally protruding stringers, that is the outer stringer 4*a* and the inner stringer 4*b*. The outer stringer 4*a* is joined to the shell 5 of a garment 13 that is not represented in any more detail by the sewn seam 9.

The inner stringer 4*b* is joined to the lining 6 of the garment 13 by means of the sewn seam 10. The impermeability to chemical and/or biological substances is achieved in the same way by a protective layer 7, which may be formed from polyurethane and extends on the two outer stringers 4*a* and likewise over the entire zip fastener 1. If need be, the two inner stringers 4*b* may also be provided with a protective layer 7.

The shell 5 or the lining 6 is of course likewise to be formed to resist the ingress of chemical or biological substances with a correspondingly impermeable material.

To prevent ingress of the harmful substances via the sewn seam 10, the inner stringer 4*b* is likewise provided in this region with the seam sealing tape 11, which is joined in a gas-impermeable manner on one side to the stringer 4*b* and on the other side to the lining 6.

FIG. 3 shows a configuration similar to FIG. 2. Instead of a one-piece strip 4 which is provided with two stringers 4*a* and 4*b* by bending over into a U shape, here there is provided, emerging from each zip fastener half 2 and 3, respectively, only one tape 4, which is divided or branched on the outer side into the outer stringer 4*a* and the inner stringer 4*b*. The outer stringer 4*a* is in this case joined in turn to the shell 5 and the inner stringer 4*b* is joined to the lining 6.

As is evident, the respective tape 4 forms a Y shape in cross section. Here, too, impermeability to chemical and/or biological substances is achieved by a protective layer 7, which is applied to the outside of the outer stringers 4*a* and extends over the zip fastener 1. In addition, here, too, the respectively inner stringer 4*b* may be provided in the region of the respectively outer branch of the Y with a protective layer 7.

What is claimed is:

1. A garment for protection against at least one of a chemical and a biological substance, the garment comprising a shell (5) with a lining (6) encased by the shell (5), the garment having at least one zip fastener (1) comprising two zip fastener halves (2, 3) which engage with one another during closing of the zip fastener, each zip fastener half (2, 3) having an inner stringer (4*a*) and an outer stringer (4*b*), the outer stringer (4*a*) of each of the two zip fastener halves (2, 3) being joined to the shell (5) and the inner stringer (4*b*) of each of the two zip fastener halves (2, 3) being joined to the lining (6), at least one of the shell (5) and the lining (6) being impermeable to the at least one of the chemical and the biological substance and at least one of the inner and the outer stringers (4*a*, 4*b*) being provided with a protective layer (7) which is impermeable to the at least one of the chemical and the biological substance.

2. The garment according to claim 1, wherein the inner stringers (4*b*) are each provided with the protective layer (7) which is impermeable to at least one of the chemical and the biological substance.

3. A garment for protection against at least one of a chemical and a biological substance, the garment comprising a shell (5) with a lining (6) encased by the shell (5), the garment having at least one zip fastener (1) comprising two zip fastener halves (2, 3) which engage with one another during closing of the zip fastener, each zip fastener half (2, 3) having an inner stringer (4*a*) and an outer stringer (4*b*), the outer stringer (4*a*) of each of the two zip fastener halves (2, 3) being joined to the shell (5) and the inner stringer (4*b*) of each of the two zip fastener halves (2, 3) being joined to the lining (6), at least one of the shell (5) and the lining (6) being impermeable to the at least one of the chemical and the biological substance and at least one of the inner and the outer stringers (4*a*, 4*b*) being provided with a protective layer (7) which is impermeable to the at least one of the chemical and the biological substance;

the inner stringers (4*b*) are each provided with the protective layer (7) which is impermeable to at least one of the chemical and the biological substance, and the two outer stringers (4*b*) are fused to the inner stringers (4*a*) by the protective layer (7).

4. The garment according to claim 1, wherein the lining (6) is impermeable to at least one of the chemical and the biological substance.

5. The garment according to claim 1, wherein the protective layer (7) is integrated in the inner stringer (4*b*).

6. The garment according to claim 1, wherein the protective layer (7) is applied to the inner stringer (4*b*).

7. The garment according to claim 1, wherein the outer stringers (4*a*) are formed from a woven fabric and the protective layer (7), in the form of a gas-impermeable coating (7), is applied to the outer stringers (4*a*).

8. The garment according to claim 1, wherein the protective layer (7) is arranged between the outer stringer (4*a*) and the inner stringer (4*b*).

9. The garment according to claim 8, wherein the protective layer (7) extends over the zip fastener (1).

10. The garment according to claim 8, wherein an inner region of the outer stringer (4*a*), adjacent to the zip fastener half (2 or 3, respectively), is joined to the protective layer (7) by a strip (8).

11. The garment according to claim 10, wherein the strip (8) and the protective layer (7) join the outer stringer (4*a*) to the associated inner stringer (4*b*).

12. The garment according to claim 8, wherein the protective layer (7) is a coating of polyurethane.

13. The garment according to claim 1, wherein the inner stringer (4*b*) is provided with a seam sealing tape (11) which forms a barrier against ingress of at least one of the chemical and the biological substance.

14. The garment according to claim 1, wherein the protective layer (7) has a thickness of from about 0.2 to 0.4 mm.

15. The garment according to claim 1, wherein the inner stringer (4*b*) is provided to relieve tension of the lining (6).

16. The garment according to claim 1, wherein the lining (6) is formed from a laminate.

17. The garment according to claim 16, wherein the laminate comprises polyester knitwear incorporating a membrane (12) which is impermeable to at least one of the chemical and the biological substance.

18. The garment according to claim 1, wherein the shell (5) comprises nylon.

19. The garment according to claim 1, wherein the inner and the outer stringers (4*a*, 4*b*) for each of the zip fastener halves (2 and 3, respectively) are formed as one piece, and each associated zip fastener half (2, 3) is secured to a middle region of the one piece, and the one piece is bent into a U shape to form the inner and the outer stringers (4*a*, 4*b*).

20. A garment for protection against at least one of a chemical and a biological substance, the garment comprising a shell (5) with a lining (6) encased by the shell (5), the garment having at least one zip fastener (1) comprising two zip fastener halves (2, 3) which engage with one another during closing of the zip fastener, each zip fastener half (2, 3) having an inner stringer (4*a*) and an outer stringer (4*b*), the outer stringer (4*a*) of each of the two zip fastener halves (2, 3) being joined to the shell (5) and the inner stringer (4*b*) of each of the two zip fastener halves (2, 3) being joined to the lining (6), at least one of the shell (5) and the lining (6) being impermeable to the at least one of the chemical and the biological substance and at least one of the inner and the outer stringers (4*a*, 4*b*) being provided with a protective layer (7) which is impermeable to the at least one of the chemical and the biological substance; and the inner and the outer stringers (4*a*, 4*b*), provided for each zip fastener half (2 and 3, respectively), are formed from a shared tape (4) which is split in an outward direction to form the inner and the outer stringers (4*a*, 4*b*).

21. A zip fastener device for protection against at least one of a chemical and a biological substance, the zip fastener device comprising two zip fastener halves (2, 3) which engage with one another during closing of the zip fastener device, each zip fastener half (2, 3) having an inner stringer (4*a*) and an outer stringer (4*b*), the outer stringer (4*a*) of each of the two zip fastener halves (2, 3) being joinable with a shell (5) and the inner stringer (4*b*) of each of the two zip fastener halves (2, 3) being joinable with a lining (6), and at least one of the inner and the outer stringers (4*a*, 4*b*) being provided with a protective layer (7) which is impermeable to the at least one of the chemical and the biological substance.

22. The zip fastener device according to claim 21, wherein the protective layer (7) is integrated in both of the inner stringers (4*b*).

23. The zip fastener device according to claim 21, wherein the protective layer (7) is applied to both of the inner stringers (4*b*).

24. The zip fastener device according to claim 21, wherein the protective layer (7) is respectively arranged between the outer stringers (4*a*) and the inner stringers (4*b*).

25. A zip fastener device for protection against at least one of a chemical and a biological substance, the zip fastener device comprising two zip fastener halves (2, 3) which engage with one another during closing of the zip fastener device, each zip fastener half (2, 3) having an inner stringer (4*a*) and an outer stringer (4*b*), the outer stringer (4*a*) of each of the two zip fastener halves (2, 3) being joinable with a shell (5) and the inner stringer (4*b*) of each of the two zip fastener halves (2, 3) being joinable with a lining (6), and at least one of the inner and the outer stringers (4*a*, 4*b*) being provided with a protective layer (7) which is impermeable to the at least one of the chemical and the biological substance; and the protective layer (7) extends over the zip fastener (1).

26. The zip fastener device according to claim 21, wherein the protective layer (7) comprises polyurethane.

27. The zip fastener device according to claim 21, wherein, for each zip fastener half (2, 3), the outer stringer (4*a*) is joined to the inner stringer (4*b*) in a region adjacent to the zip fastener device (1).

28. A zip fastener device for protection against at least one of a chemical and a biological substance, the zip fastener device comprising two zip fastener halves (2, 3) which engage with one another during closing of the zip fastener device, each zip fastener half (2, 3) having an inner stringer (4*a*) and an outer stringer (4*b*), the outer stringer (4*a*) of each of the two zip fastener halves (2, 3) being joinable with a shell (5) and the inner stringer (4*b*) of each of the two zip fastener halves (2, 3) being joinable with a lining (6), and at least one of the inner and the outer stringers (4*a*, 4*b*) being provided with a protective layer (7) which is impermeable to the at least one of the chemical and the biological substance; and for each zip fastener half (2, 3), the outer stringer (4*a*) is joined to the inner stringer (4*b*) in a region adjacent to the zip fastener device (1); and the joining of the outer stringer (4*a*) to the inner stringer (4*b*) is by a strip (8) with the protective layer (7) lying between the outer stringer (4*a*) and the inner stringer (4*b*).

* * * * *